US011061353B2

(12) United States Patent
Mizuta et al.

(10) Patent No.: US 11,061,353 B2
(45) Date of Patent: Jul. 13, 2021

(54) IMAGE FORMING APPARATUS

(71) Applicant: CANON KABUSHIKI KAISHA, Tokyo (JP)

(72) Inventors: Takayuki Mizuta, Numazu (JP); Kenichirou Isobe, Yokohama (JP); Tomooku Koyama, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/789,805

(22) Filed: Feb. 13, 2020

(65) Prior Publication Data

US 2020/0278634 A1 Sep. 3, 2020

(30) Foreign Application Priority Data

Feb. 28, 2019 (JP) ..... JP2019-036269

(51) Int. Cl.

*B65H 29/12* (2006.01)
*G03G 15/00* (2006.01)
*B65H 29/58* (2006.01)

(52) U.S. Cl.

CPC ..... *G03G 15/6529* (2013.01); *B65H 29/125* (2013.01); *B65H 29/58* (2013.01); *B65H 2301/5121* (2013.01); *B65H 2405/142* (2013.01)

(58) Field of Classification Search

CPC ..... B65H 29/70; B65H 2301/33312; B65H 2301/3331; B65H 2301/5122; B65H 2301/51214; B65H 2301/51212; B65H 2301/512; B65H 2405/142

See application file for complete search history.

(56) References Cited

U.S. PATENT DOCUMENTS

| | | | | |
|---|---|---|---|---|
| 8,328,195 | B2 * | 12/2012 | Rosacker | B65H 5/062 271/301 |
| 8,811,849 | B2 * | 8/2014 | Masuda | B65H 5/26 399/92 |
| 9,738,478 | B2 | 8/2017 | Makino | |
| 2006/0062619 | A1 | 3/2006 | Tanjo | |
| 2010/0276871 | A1 * | 11/2010 | Mizuno | B65H 9/006 271/225 |
| 2016/0016743 | A1 * | 1/2016 | Kougami | B65H 29/125 271/3.2 |
| 2017/0066609 | A1 * | 3/2017 | Inoue | B65H 5/26 |

FOREIGN PATENT DOCUMENTS

| | | | |
|---|---|---|---|
| JP | 2004345842 | A | 12/2004 |
| JP | 2005141019 | A | 6/2005 |
| JP | 2006089184 | A | 4/2006 |
| JP | 2016118773 | A | 6/2016 |
| JP | 2016194545 | A | 11/2016 |

* cited by examiner

*Primary Examiner* — Howard J Sanders

(74) *Attorney, Agent, or Firm* — Rossi, Kimms & McDowell LLP

(57) ABSTRACT

An upstream roller pair and a downstream roller pair are disposed on a first conveyance path and configured to perform a reverse conveyance operation on a sheet. The upstream roller pair includes a first roller and a second roller abutting with each other. The downstream roller pair is configured to nip and convey a sheet by a third roller and a fourth roller in a state that areas in a width direction where a plurality of first rotary members contact a first surface of a sheet do not overlap with areas in the width direction where a plurality of second rotary members contact a second surface of a sheet opposite to the first surface.

16 Claims, 11 Drawing Sheets

IMAGE FORMING APPARATUS

BACKGROUND OF THE INVENTION

Field of the Invention

The present invention relates to an image forming apparatus that forms images on sheets.

Description of the Related Art

Some of image forming apparatuses, such as printers, copying machines, and commercial printers, have a duplex printing function that forms an image on a first surface of a sheet, which is a recording medium, reverses the sheet to form an image on a second surface of the sheet, and discharges the sheet. The image forming apparatus that performs duplex printing commonly has a reconveyance path that branches from a discharging path of the sheet, and sends the sheet to the reconveyance path. Specifically, the image forming apparatus causes a roller pair to convey the sheet to a predetermined position, and then causes the roller pair to rotate in a reverse direction for reversing a sheet conveyance direction. With these operations, the sheet is sent to the reconveyance path.

The roller pair that reverses and conveys the sheet in the duplex printing may serve also as a discharging roller pair, which discharges an image-formed sheet to the outside of the image forming apparatus. Japanese Patent Application Publication No. 2016-118773 discloses a technique in which a reversing roller pair is disposed upstream of a discharging roller pair in a sheet discharging direction and both the discharging roller pair and the reversing roller pair nip a sheet for reversing and conveying the sheet. In this case, since a branching portion at which the reconveyance path branches from the sheet discharging path is disposed upstream of the reversing roller pair, a conveyance path in which the sheet is reversed and reconveyed to an image forming portion can be reduced in length.

However, when both the two roller pairs nip a sheet for reversing and conveying the sheet like the discharging roller pair and the reversing roller pair described in Japanese Patent Application Publication No. 2016-118773, the conveyance of the sheet may become unstable.

SUMMARY OF THE INVENTION

The present invention provides an image forming apparatus that can realize stable sheet conveyance.

According to one aspect of the invention, an image forming apparatus includes: an image forming portion configured to form an image on a sheet; a first conveyance path through which a sheet passes in a case where a sheet on which an image has been formed by the image forming portion is discharged to an outside of the image forming apparatus; a second conveyance path which branches from the first conveyance path and through which a sheet passes in a case where a sheet on which an image has been formed by the image forming portion is conveyed toward the image forming portion again; an upstream roller pair disposed on the first conveyance path and positioned downstream of, in a sheet discharging direction in the first conveyance path, a position at which the second conveyance path branches from the first conveyance path, the upstream roller pair including a first roller and a second roller abutting with each other and being configured to nip and convey a sheet by the first roller and the second roller; and a downstream roller pair disposed on the first conveyance path and positioned downstream of the upstream roller pair in the sheet discharging direction, the downstream roller pair including a third roller including a plurality of first rotary members aligned in a width direction orthogonal to the sheet discharging direction and a fourth roller including a plurality of second rotary members arranged on positions in the width direction alternately with positions of the plurality of first rotary members in the width direction, the plurality of first rotary members being configured to overlap at least partially with the plurality of second rotary members when viewed from the width direction, wherein the downstream roller pair is configured to nip and convey a sheet by the third roller and the fourth roller in a state that areas in the width direction where the plurality of first rotary members contact a first surface of a sheet do not overlap with areas in the width direction where the plurality of second rotary members contact a second surface of a sheet opposite to the first surface, and wherein the image forming apparatus is configured to perform a reverse conveyance operation in which a sheet on which an image has been formed by the image forming portion is conveyed in the sheet discharging direction by both the upstream roller pair and the downstream roller pair and is then conveyed in a reverse direction opposite to the sheet discharging direction to the second conveyance path by both the upstream roller pair and the downstream roller pair.

Further features of the present invention will become apparent from the following description of exemplary embodiments with reference to the attached drawings.

DESCRIPTION OF THE EMBODIMENTS

Hereinafter, exemplary embodiments of the present invention will be described with reference to the accompanying drawings.

First Embodiment

Figure 1:
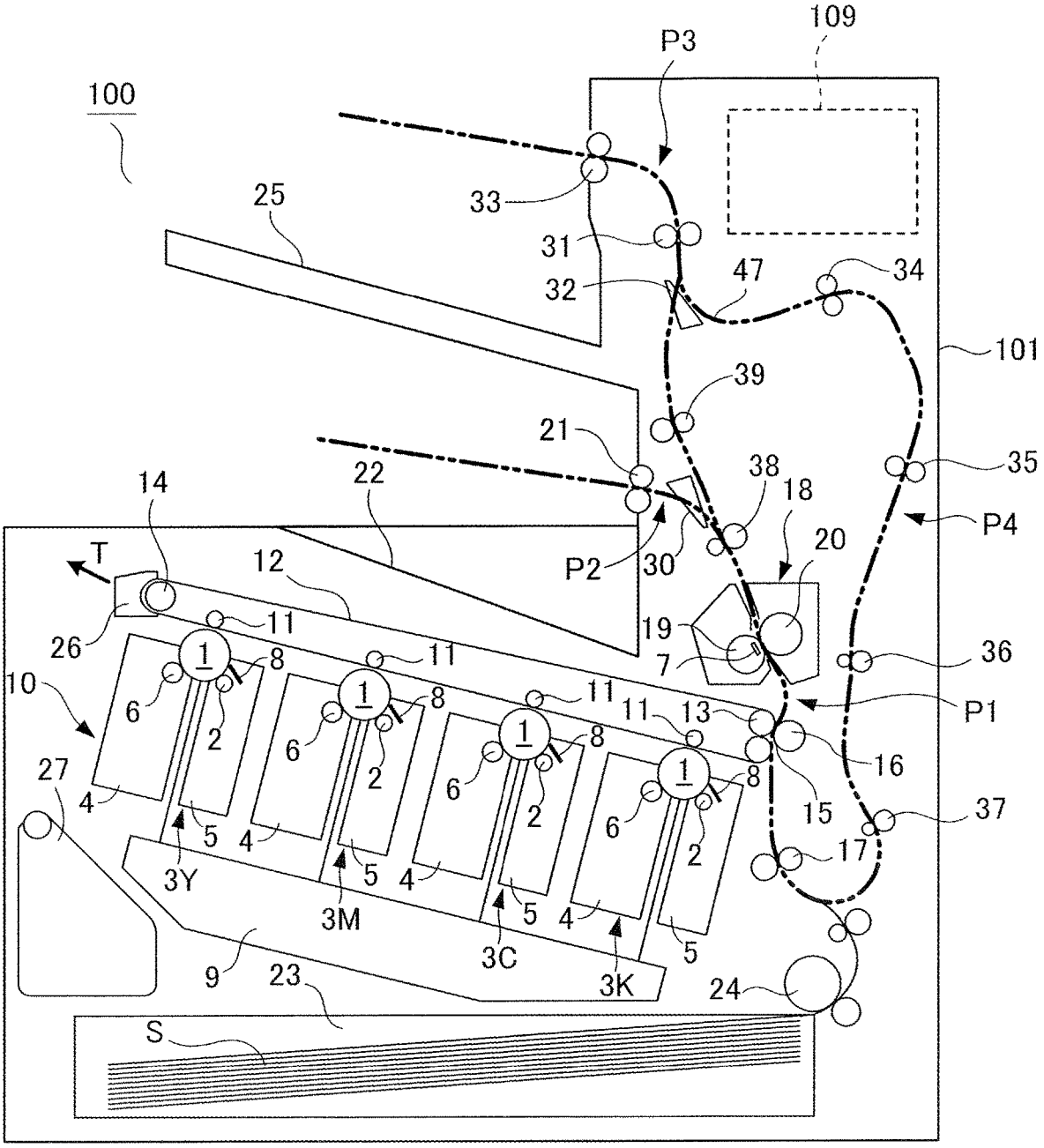
FIG. 1 is a schematic diagram illustrating an image forming apparatus of a first embodiment.

FIG. 1 is a schematic diagram illustrating a printer 100 that is an image forming apparatus of a first embodiment. The printer 100 is a color laser-beam printer including an electrophotographic image forming process portion 10. The printer 100 mainly includes the image forming process portion, a sheet feeding portion, a secondary transfer portion, a fixing-and-discharging portion, and a duplex conveyance portion. Hereinafter, configurations and operations of these portions will be described sequentially.

Image Forming Process Portion

The image forming process portion 10, which is an image forming portion of the present embodiment, has a tandem-type intermediate transfer system including four process cartridges 3Y, 3M, 3C, and 3K and an intermediate transfer belt 12. Each of the process cartridges includes a photosensitive drum 1 serving as an image bearing member, and the intermediate transfer belt 12 serves as an intermediate transfer member. The image forming process portion 10 forms a toner image of yellow, magenta, cyan, or black on the surface of the photosensitive drum 1 of each process cartridge, and transfers toner images of these colors onto a recording medium via the intermediate transfer belt 12. The sheet used as the recording medium may be of a variety of sheets having different materials and sizes. For example, the sheet may be a paper sheet such as a plain paper sheet or a thick paper sheet, a plastic film used for overhead projectors, a specialized shape of sheet such as an envelope or an index paper sheet, or a cloth sheet.

Each of the process cartridges 3Y to 3K includes a developing unit 4 and a cleaner unit 5. The developing unit 4 includes a developing roller 6, and the cleaner unit 5 includes the photosensitive drum 1, a charging roller 2, and a drum cleaner 8. When the image forming process portion 10 forms an image, the charging roller 2 first charges the surface of the rotating photosensitive drum 1 uniformly. A scanner unit 9 is disposed below the process cartridges 3Y to 3K in a vertical direction (i.e., gravity direction), and forms an electrostatic latent image on the surface of the photosensitive drum 1 by exposing the surface by irradiating the surface with a laser beam in accordance with the data on the image to be outputted. The developing roller 6 bears developer, and supplies the developer to the photosensitive drum 1 to develop the electrostatic latent image into a toner image of each color.

The toner image borne by the photosensitive drum 1 is primary-transferred onto the intermediate transfer belt 12 by a primary transfer roller 11. In this time, one toner image having one color is superposed on another toner image having another color, on the intermediate transfer belt 12, so that a full-color toner image is formed. Sticking substance, such as remaining toner that has not been transferred onto the intermediate transfer belt 12 and is left on the surface of the photosensitive drum 1, is removed by the drum cleaner 8 and collected in a collection container 27.

The intermediate transfer belt 12 is stretched and wound around a driving roller 13 and a tension roller 14. The tension roller 14 applies tension to the intermediate transfer belt 12 toward a direction indicated by an arrow T. The driving roller 13 rotates the intermediate transfer belt 12 counterclockwise in FIG. 1, in accordance with a rotational direction (i.e. clockwise direction in FIG. 1) of the photosensitive drum 1. The full-color toner image borne by the intermediate transfer belt 12 is conveyed, by the rotation of the intermediate transfer belt 12, toward a secondary transfer portion 15 at which the driving roller 13 and a secondary transfer roller 16 face each other. Sticking substance, such as remaining toner that has not been transferred onto a sheet in the secondary transfer portion 15 and is left on the surface of the intermediate transfer belt 12, is removed by a belt cleaner 26 and collected in the collection container 27.

Sheet Feeding Portion

The sheet feeding portion includes a feeding cassette 23 that serves as a sheet storing portion to store sheets (which are recording media), and a feed roller 24 that serves as a feeding member to feed the sheets. The feeding cassette 23 can be inserted to and drawn from a printer body 101, which is an apparatus body of the printer 100. With driving force supplied by a driving unit (not illustrated), the feed roller 24 feeds a sheet S stacked on the feeding cassette 23. In this feeding operation, the sheet S is fed, separated from the other sheets, one by one, by a separation member such as a separation roller that abuts against the feed roller 24.

When the sheet S fed by the feed roller 24 abuts against a nip portion of a registration roller 17 that is in a stop state, the sheet S is bent (or forcibly warped), and the skew of the sheet S is corrected such that the leading edge of the sheet (i.e. downstream edge of the sheet in the sheet conveyance direction) becomes parallel to the nip portion. The registration roller 17 restarts the conveyance of the sheet S and sends the sheet S toward the secondary transfer portion 15 in synchronization with the toner-image formation process performed by the image forming process portion 10.

Secondary Transfer Portion

The secondary transfer portion 15 is a nip portion between the secondary transfer roller 16 and the intermediate transfer belt 12, which are examples of transfer members. In the secondary transfer portion 15, a bias voltage with a polarity opposite to a normal polarity of charged toner is applied to the secondary transfer roller 16, so that the toner image borne on the intermediate transfer belt 12 is secondary-transferred onto the sheet S.

Hereinafter, a conveyance path of the sheet S that passes through the secondary transfer portion 15 (i.e. sheet conveyance path for forming an image on the sheet S) is referred to as an image forming path P1.

Fixing-and-Discharging Portion

The fixing-and-discharging portion includes a fixing apparatus 18, a delivery guide member 30, and a discharging roller pair 21. The fixing apparatus 18 performs fixing process on the toner image having been transferred onto the sheet S in the secondary transfer portion 15. The fixing apparatus 18 includes a fixing film 19, a heater 7, and a pressure roller 20. The fixing film 19 serves as a fixing member. The heater 7 serves as a heating member that heats, via the fixing member, the toner image formed on the sheet. The pressure roller 20 serves as a pressure member that presses the toner image while the toner image is nipped by the pressure roller 20 and the fixing film 19. When the sheet S enters a fixing nip portion between the fixing film 19 and the pressure roller 20, the toner image is heated and pressed, so that toner particles melt and colors of the toner particles mix with each other. After that, as the temperature of the toner falls, the toner adheres to the sheet S, and the image is fixed to the sheet S.

Note that the heater 7 may be a ceramic heater. Instead of the fixing film 19 and the pressure roller 20, a rigid fixing roller and the pressure roller 20 may be used for nipping and pressing the sheet S.

The sheet S having passed through the fixing apparatus 18 is conveyed upward in the vertical direction by the conveyance roller pair 38, and reaches the delivery guide member 30. The delivery guide member 30 delivers the sheet S that has been conveyed through the image forming path P1, to a lower discharging path P2 or an upper discharging path P3.

The lower discharging path P2 extends from a position at which the lower discharging path P2 is branched from the image forming path P1 by the delivery guide member 30, through the discharging roller pair 21, to the outside of the printer body 101. The upper discharging path P3, which is a first conveyance path of the present embodiment, extends from the position at which the lower discharging path P2 is branched from the image forming path P1 by the delivery guide member 30, through a later-described discharging roller pair 33, to the outside of the printer body 101.

When the sheet S is to be discharged to a lower discharging tray 22, the delivery guide member 30 guides the sheet S to the lower discharging path P2. The discharging roller pair 21 receives the sheet S, which has been guided to the lower discharging path P2, and discharges the sheet S to the lower discharging tray 22 disposed on an upper surface of the printer body 101. When the sheet S is to be discharged to an upper discharging tray 25, or when the sheet is to be reversed for duplex printing, the delivery guide member 30 guides the sheet S to the upper discharging path P3.

Duplex Conveyance Portion

The duplex conveyance portion performs a discharging operation and a reverse conveyance operation. In the discharging operation, the duplex conveyance portion discharges the sheet S, which has been guided to the upper discharging path P3, to the upper discharging tray 25. In the reverse conveyance operation, the duplex conveyance portion reverses and sends the sheet S, which has been guided to the upper discharging path P3, to a reconveyance path P4. The reconveyance path P4, which is a second conveyance path of the present embodiment, branches from the upper discharging path P3 in the printer body 101, and joins with the image forming path P1 in a portion of the image forming path P1 between the feed roller 24 and the registration roller 17.

The duplex conveyance portion includes a conveyance roller pair 39, a delivery guide member 32, a reversing roller pair 31, a discharging roller pair 33, and reconveyance roller pairs 34, 35, 36, and 37. Hereinafter, a direction in which the sheet S moves when conveyed through the upper discharging path P3 and discharged to the upper discharging tray 25 is referred to as a sheet discharging direction. In contrast to the sheet discharging direction, a direction in which the sheet S moves from the discharging roller pair 33 through the reversing roller pair 31 toward the delivery guide member 32 is referred to as a reverse direction. When the sheet discharging direction and the reverse direction need not to be distinguished, they are collectively referred to as a sheet conveyance direction. In the upper discharging path P3, the conveyance roller pair 39, the delivery guide member 32, the reversing roller pair 31, and the discharging roller pair 33 are arranged in this order from an upstream side toward a downstream side in the sheet discharging direction. In the present embodiment, the reversing roller pair 31 serves as an upstream roller pair, and the discharging roller pair 33 serves as a downstream roller pair.

The conveyance roller pair 39 conveys the sheet S, which has been guided to the upper discharging path P3 by the delivery guide member 30, upward in the vertical direction. On the upstream side with respect to the reversing roller pair 31 in the sheet discharging direction, guides 40*a* and 40*b* (see FIG. 2) are disposed. The sheet S conveyed by the conveyance roller pair 39 passes through a space between the delivery guide member 32 and the guide 40*a*, and is delivered to the reversing roller pair 31.

The reversing roller pair 31 receives the sheet S from the conveyance roller pair 39, and further conveys the sheet S toward the discharging roller pair 33 in the sheet discharging direction. When the discharging operation is performed, the sheet S is directly discharged to the upper discharging tray 25 by the discharging roller pair 33. The upper discharging tray 25 of the present embodiment is located above the lower discharging tray 22 and projects from the printer body 101. In addition, when viewed from the vertical direction, the upper discharging tray 25 is located so as to overlap with the lower discharging tray 22.

In a case where the reverse conveyance operation is performed, the rotational direction of the reversing roller pair 31 and the discharging roller pair 33 is reversed after the trailing edge of the sheet S (i.e. upstream edge of the sheet in the sheet discharging direction) has passed the position of the delivery guide member 32 and before the trailing edge of the sheet S passes through the nip portion of the reversing roller pair 31. With this operation, the sheet S starts to be conveyed toward the reverse direction. In addition, as illustrated in FIG. 1, the delivery guide member 32 switches to a position at which the delivery guide member 32 guides the sheet S to the reconveyance path P4. With this operation, the sheet S, which has been conveyed through the upper discharging path P3, is switchbacked and is sent to the reconveyance path P4 by passing through a space between the delivery guide member 32 and the guide 40*b*.

The sheet S conveyed to the reconveyance path P4 is conveyed to the registration roller 17 again by the reconveyance roller pairs 34 to 37, and sent to the secondary transfer portion 15 by the registration roller 17. In this time, a toner image is transferred onto a surface (second surface) of the sheet S opposite to a surface (first surface) onto which a toner image was transferred when the sheet S passed through the image forming path P1 for the first time. After that, the sheet S is subjected to the fixing operation performed by the fixing apparatus 18, then guided to the lower discharging path P2 or the upper discharging path P3 by the delivery guide member 30, and then discharged to the discharging tray 22 or 25 by the discharging roller pair 21 or 33.

Detailed Description of Duplex Conveyance Portion

Figure 2:
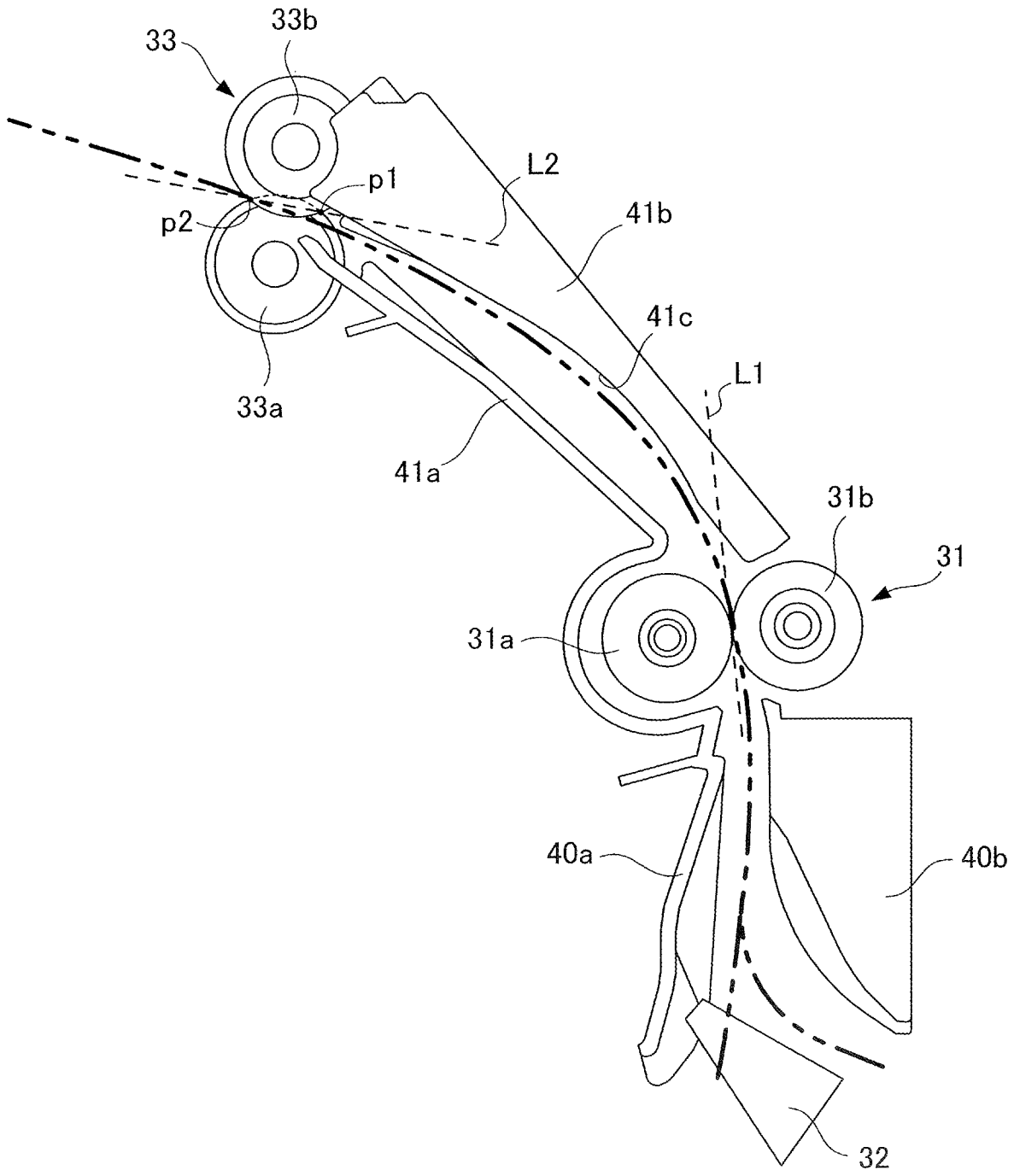
FIG. 2 is a schematic diagram illustrating part of a duplex conveyance portion of the first embodiment.
Figure 3:
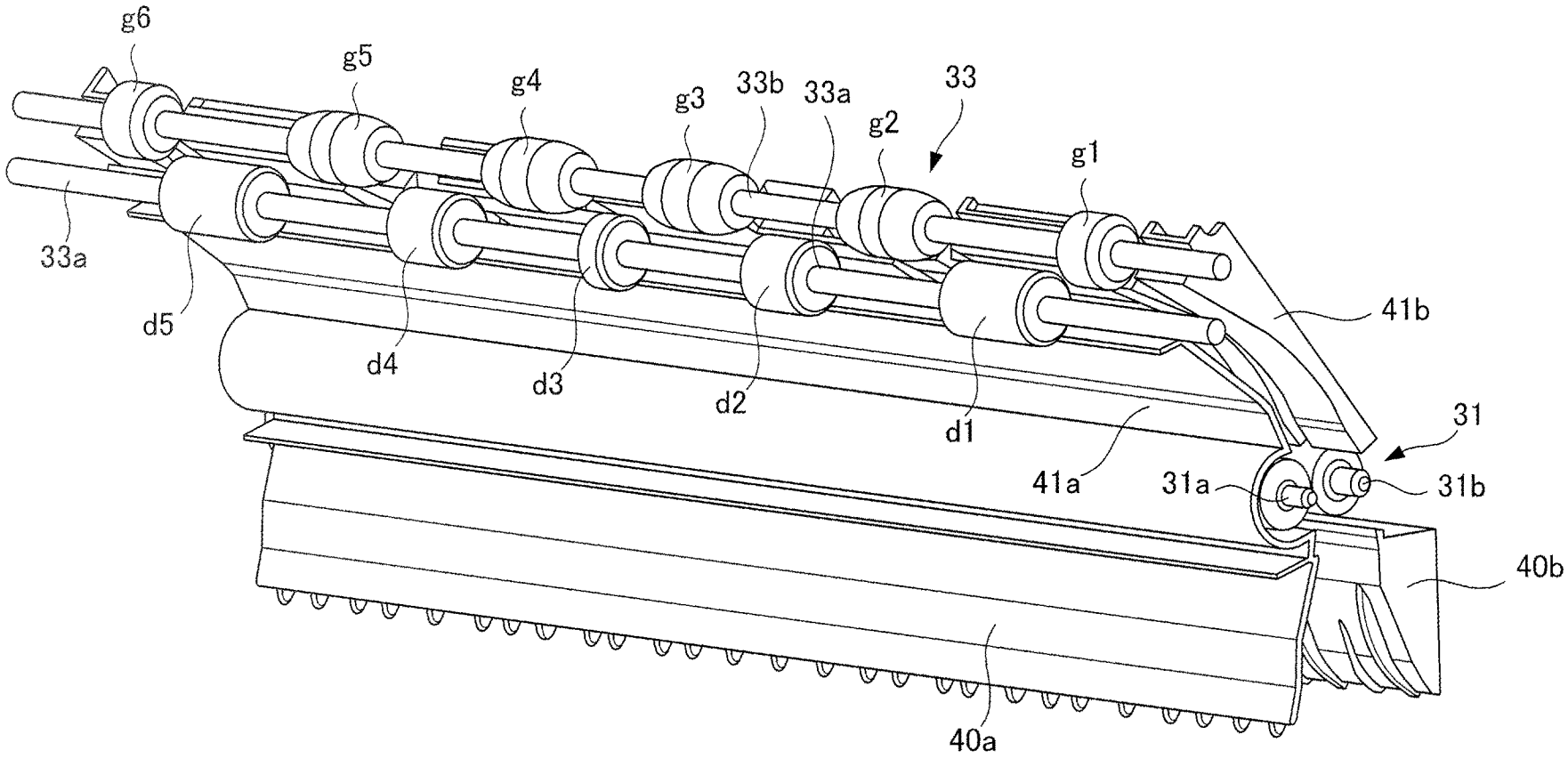
FIG. 3 is a perspective view illustrating part of the duplex conveyance portion of the first embodiment.

Next, a detailed configuration and operation of the duplex conveyance portion will be described. FIG. 2 is a schematic diagram seen from a width direction of a sheet and illustrating part of the duplex conveyance portion. FIG. 3 is a perspective view of the part of the duplex conveyance portion. The width direction of the sheet is a direction orthogonal to the sheet discharging direction of the upper discharging path P3. In the present embodiment, the width direction is equal to a front-rear direction of the printer 100 when a viewpoint of FIG. 1 is defined as a front side of the printer 100.

As illustrated in FIGS. 2 and 3, the reversing roller pair 31 includes a driving roller 31*b* and a driven roller 31*a*. The driving roller 31*b* is rotated by driving force from a driving source, and the driven roller 31*a* is rotated following the rotation of the driving roller 31*b*. The driving roller 31*b* and the driven roller 31*a* are disposed such that the axial direction of the driving roller 31*b* and the driven roller 31*a* is equal to the width direction of a sheet. At least one of the driving roller 31*b* and the driven roller 31*a* (especially the driving roller 31*b* that applies conveyance force to the sheet) has an outer circumferential portion made of elastic material such as rubber.

The driven roller 31*a* is a roller that abuts against a surface (hereinafter referred to as an image surface) of the sheet onto which a toner image is transferred in the image forming path P1 when the sheet is guided from the image forming path P1 to the upper discharging path P3. The driving roller 31*b* is a roller that abuts against a surface of the sheet opposite to the image surface. The driven roller 31*a* serves as a first roller of the present embodiment, and the driving roller 31*b* serves as a second roller of the present embodiment. Note that in the duplex printing, when the sheet is conveyed through the upper discharging path P3 in a state where an image is formed on the second surface of the sheet, the image surface of the sheet is the second surface in the upper discharging path P3, and the surface opposite to the image surface is the first surface on which an image has already been formed.

Each of the driving roller 31*b* and the driven roller 31*a* has a cylindrical outer circumferential surface, and the outer circumferential surface of the driving roller 31*b* and the outer circumferential surface of the driven roller 31*a* abut against each other. Each of the driving roller 31*b* and the driven roller 31*a* of the reversing roller pair 31 has a substantially constant outer diameter, and extends more than an image forming area in the width direction. The image forming area is a maximum area in which the image forming portion can form an image on the sheet in the width direction. In the present embodiment, the image forming area is equivalent to a maximum width in a main scanning direction, in which the scanner unit 9 can form an electrostatic latent image. Thus, the nip portion of the reversing roller pair 31 of the present embodiment extends in the width direction, over an area containing the entire image forming area.

The discharging roller pair 33 includes a discharging lower roller 33*a* and a discharging upper roller 33*b*. The discharging lower roller 33*a* abuts against the image surface of the sheet having been guided from the image forming path P1 to the upper discharging path P3. The discharging upper roller 33*b* abuts against the surface of the sheet opposite to the image surface. As described later, the discharging lower roller 33*a* and the discharging upper roller 33*b* of the present embodiment are both driving rollers connected to the driving source.

The discharging lower roller 33*a* of the discharging roller pair 33 is provided with conveyance rollers d1 to d5, at a plurality of positions in the width direction, on a shaft of the discharging lower roller 33*a*. Similarly, the discharging upper roller 33*b* is provided with conveyance rollers g1 to g6, at a plurality of positions in the width direction, on a shaft the discharging upper roller 33*b*. The discharging lower roller 33*a* serves as a third roller of the present embodiment, and the discharging upper roller 33*b* serves as a fourth roller of the present embodiment. The conveyance rollers d1 to d5 are examples of a plurality of first rotary members, and the conveyance rollers g1 to g6 are examples of at least one second rotary member (a plurality of second rotary members).

The discharging roller pair 33 is a so-called comb-teeth roller pair in which the conveyance rollers d1 to d5 of the discharging lower roller 33*a* and the conveyance rollers g1 to g6 of the discharging upper roller 33*b* are arranged alternately in terms of positions in the width direction. That is, each of the conveyance rollers d1 to d5 of the discharging lower roller 33*a* is disposed between adjacent ones of the conveyance rollers g1 to g6 of the discharging upper roller 33*b* in the axial direction of the discharging lower roller 33*a* and the discharging upper roller 33*b* (i.e. width direction in the present embodiment), and outer circumferential surfaces of the conveyance rollers d1 to d5 are not in contact with outer circumferential surfaces of the conveyance rollers g1 to g6. In addition, the distance (distance between axes) between an axis of the discharging lower roller 33*a* and an axis of the discharging upper roller 33*b* is smaller than the sum of the radius (i.e., half of outer diameter) of one of the conveyance rollers d1 to d5 and the radius of one of the conveyance rollers g1 to g6 that is adjacent to the one of the conveyance rollers d1 to d5 in the width direction. In other words, the discharging lower roller 33*a* and the discharging upper roller 33*b* has a positional relationship in which when viewed from the width direction, part of the outer circumferential surfaces of the conveyance rollers d1 to d5 overlap at least partially with the conveyance rollers g1 to g6.

The sheet nipped by such a comb-teeth discharging roller pair 33 becomes a waved shape when viewed from the downstream side in the sheet discharging direction, by being held between the conveyance rollers d1 to d5 and the conveyance rollers g1 to g6. In other words, in the discharging roller pair 33 that serves as the downstream roller pair, the sheet is nipped by the third roller and the fourth roller in a state that areas in the width direction where the plurality of first rotary members contact a first surface of the sheet do not overlap with areas in the width direction where the plurality of second rotary members contact a second surface of the sheet opposite to the first surface. That is, the sheet is nipped by the third roller and the fourth roller in a state where the fourth roller is not in contact with the second surface of the sheet, opposite to the first surface, at positions in the width direction at which the plurality of first rotary members are in contact with the first surface of the sheet, and where the third roller is not in contact with the first surface of the sheet at positions in the width direction at which the plurality of second rotary members are in contact with the second surface of the sheet. Note that even when the discharging upper roller 33*b* has a single conveyance roller and the discharging lower roller 33*a* has two conveyance rollers for example, the sheet can be waved (that is, the sheet is curved like a U shape when viewed from the downstream side in the sheet discharging direction).

As described later, for allowing the discharging roller pair 33 to slip on the sheet, the conveyance rollers d1 to d5 and g1 to g6 are suitably made of synthetic resin softer than material of the reversing roller pair 31. For example, if the outer circumferential portion of the driving roller 31*b* of the reversing roller pair 31 is made of rubber material such as silicone rubber, the conveyance rollers d1 to d5 and g1 to g6 are made of urethane foam resin such as sponge. In addition, it is suitable to select materials of the conveyance rollers d1 to d5 and g1 to g6 and the driving roller 31*b* such that the static friction coefficients of the conveyance rollers, d1 to d5 and g1 to g6, to plain paper are smaller than the static friction coefficient of the driving roller 31*b* of the reversing roller pair 31 to the plain paper.

As illustrated in FIG. 2, the upper discharging path P3 is curved in a portion of the upper discharging path P3 between the reversing roller pair 31 and the discharging roller pair 33. That is, when viewed from the width direction, a nip line L1 of the reversing roller pair 31 crosses a nip line L2 of the discharging roller pair 33. The nip line of a roller pair, when viewed from the width direction, passes through a nip position of the roller pair and extends in a direction perpendicular to a straight line connecting axes of the two rollers of the roller pair. The nip position of the roller pair, when the outer circumferential surfaces of the rollers are in contact with each other as in the reversing roller pair 31, is centered in a contact area in the sheet conveyance direction. In addition, in a comb-teeth roller pair like the discharging roller pair 33, the nip position, when viewed from the width direction, is located at a point at which a straight line passing through two points, p1 and p2, crosses a straight line connecting the axes of the rollers. The two points, p1 and p2, are points at which the outer circumferential surfaces of the rollers cross each other.

The guides, 41*a* and 41*b*, formed between the reversing roller pair 31 and the discharging roller pair 33 for guiding the sheet are arranged so as to allow the sheet to bend. Specifically, the guide 41*b* that faces the surface of the sheet opposite to the image surface has a guide surface 41*c*. The guide surface 41*c*, when viewed from the width direction, is substantially tangent to the nip lines L1 and L2, and curves along a curved line (alternate long and two short dashed line) that is curved at a substantially constant curvature. The guide 41*a* that faces the image surface of the sheet is positioned on the same side as the center of the curvature with respect to the curved line. In other words, the sheet nipped by the reversing roller pair 31 and the discharging roller pair 33 is bent such that the curved inner surface of the sheet becomes the image surface and the curved outer surface of the sheet becomes the surface opposite to the image surface. The guide 41*a* is an inner guide of the present embodiment, located inside the bent sheet; and the guide 41*b* is an outer guide of the present embodiment, located outside the bent sheet.

In the present embodiment, the upper discharging path P3 is relatively sharply curved in a portion of the upper discharging path P3 between the reversing roller pair 31 and the discharging roller pair 33. The sharp curve is defined as a curve in which an angle formed by the nip line L1 of the reversing roller pair 31 and the nip line L2 of the discharging roller pair 33 is 45 degrees or more. In the configuration illustrated in FIG. 2, the angle formed by the nip line L1 and the nip line L2 is 70 degrees or more. Note that the distance between the reversing roller pair 31 and the discharging roller pair 33 in the sheet conveyance direction is set to be smaller than the length of a sheet whose length in the sheet conveyance direction is smallest among sheets that can be discharged or reversed and conveyed via the upper discharging path P3.

Since such a curved conveyance path creates a space in the printer body 101 to dispose other components, the image forming apparatus can be downsized. For example, a space 109 illustrated in FIG. 1 overlaps with the discharging roller pair 33 when viewed horizontally from the right side in FIG. 1, and has increased size because the upper discharging path P3 is curved. In addition, in the example of FIG. 1, the reconveyance path P4 also has a curved portion 47, and the path extending from the discharging roller pair 33 to the reconveyance roller pair 34 is S-shaped. Thus, when viewed from the vertical direction, the space 109 overlaps also with the reconveyance path P4. As an example, when an image reading apparatus to read image information data from a document is installed on the printer body 101, a frame to bear the weight of the image reading apparatus can be disposed in the space 109. In addition, a fan to send air may be disposed in the space 109 for cooling the sheet conveyed through the reconveyance path P4.

Conveyance Force in Reverse Conveyance Operation

Figure 4:
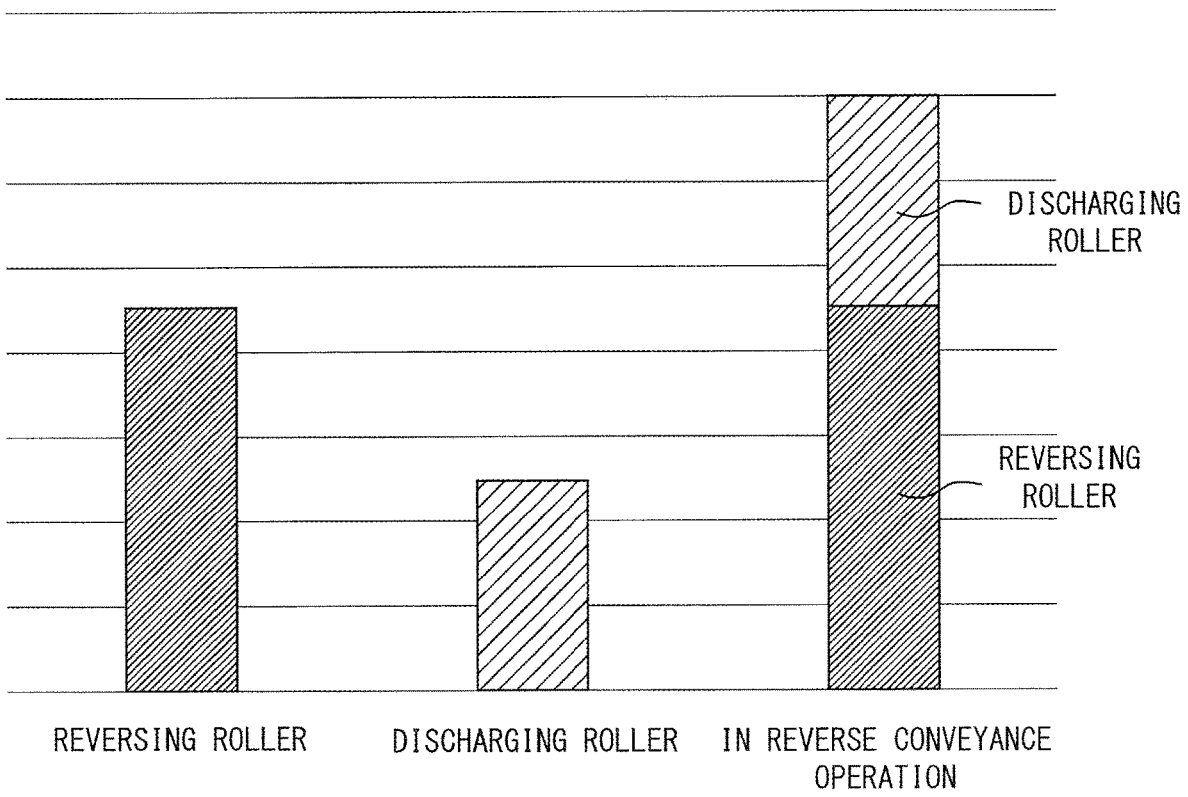
FIG. 4 is a graph illustrating a relationship in conveyance force between a reversing roller pair and a discharging roller pair of the first embodiment.

Next, a difference in conveyance force (applied to the sheet in the reverse conveyance operation) between the reversing roller pair 31 and the discharging roller pair 33 will be described. FIG. 4 illustrates conveyance force applied to the sheet when the sheet is nipped by the reversing roller pair 31 alone (left), the discharging roller pair 33 alone (center), or both the reversing roller pair 31 and the discharging roller pair 33 (right).

The conveyance force is an upper limit of force that can be applied to the sheet in the sheet conveyance direction by a roller pair, without the roller pair slipping on the sheet. In other words, the value of the conveyance force is obtained by calculating a product of a normal force value and a static friction coefficient in a contact area between the roller pair and the sheet, and integrating the product with respect to the whole contact area.

In the present embodiment, since the discharging roller pair 33 is a comb-teeth roller pair in which the outer circumferential surface of one roller is not in contact with the outer circumferential surface of the other roller, the conveyance force of the discharging roller pair 33 is smaller than that of the reversing roller pair 31 (almost half in the example illustrated in FIG. 4). In other words, an upper limit of the conveyance force of the downstream roller pair, which can be applied to the sheet without the downstream roller pair slipping on the sheet, is smaller than an upper limit of the conveyance force of the upstream roller pair, which can be applied to the sheet without the upstream roller pair slipping on the sheet. FIG. 4 illustrates measurement results obtained when a thick paper sheet having a grammage of 200 g/m$^2$ was used as the sheet. If a plain paper sheet or a thin paper sheet having less stiffness is used, the difference in conveyance force between the discharging roller pair 33 and the reversing roller pair 31 will further increase. This is because the less stiffness of sheet reduces the contact pressure between the conveyance rollers d1 to d5 and g1 to g6 of the discharging roller pair 33 and the sheet, but hardly changes the contact pressure between the reversing roller pair 31 and the sheet.

The difference in conveyance force between the reversing roller pair 31 and the discharging roller pair 33 can be represented also as the difference in pull-out load regarding a roller pair to pull out a sheet. The pull-out load regarding a roller pair is a load required to pull out a sheet nipped by the roller pair, in the sheet conveyance direction in a stop state where the roller pair is fixed so as not to rotate. The conveyance force illustrated in FIG. 4 represents frictional force that the reversing roller pair 31 and/or the discharging roller pair 33 can apply to the sheet without the reversing roller pair 31 and/or the discharging roller pair 33 slipping on the sheet. Thus, the pull-out load regarding each roller pair to pull out the sheet is basically the same as the conveyance force illustrated in FIG. 4. Thus, in the present embodiment, the pull-out load regarding the discharging roller pair 33 to pull out the sheet from the discharging roller pair 33 is smaller than the pull-out load regarding the reversing roller pair 31 to pull out the sheet from the reversing roller pair 31.

The conveyance force of the discharging roller pair 33 can be controlled using the interval of the conveyance rollers d1 to d5 and g1 to g6 in the width direction and the amount of bite of the conveyance rollers, d1 to d5 and g1 to g6, to the sheet. The amount of bite of the conveyance rollers to the sheet is the difference between (i) the sum of the radius of the discharging lower roller 33*a* and the radius of the discharging upper roller 33*b* and (ii) the distance between the axis of the discharging lower roller 33*a* and the axis of the discharging upper roller 33*b*. Thus, the pressing force of the conveyance rollers to the sheet can be changed by adjusting the amount of bite.

On the other hand, at least one of the driving roller 31*b* and the driven roller 31*a* is pressed against the other roller via a spring member (not illustrated). Thus, the pressing force of the reversing roller pair 31 to the sheet is produced mainly by the urging force of the spring member.

In the reverse conveyance operation, the sheet is conveyed by the resultant force (right in FIG. 4) of the conveyance force applied by the reversing roller pair 31 and the conveyance force applied by the discharging roller pair 33. Thus, the sheet can be stably conveyed, compared to a sheet that is conveyed by only one of the reversing roller pair 31 and the discharging roller pair 33. In particular, in a case where the conveyance path of the sheet is sharply curved in a portion of the conveyance path between the reversing roller pair 31 and the discharging roller pair 33 as in the present embodiment, even a stiff sheet such as a thick paper sheet can be stably conveyed against the conveyance resistance.

Drivetrain of Duplex Conveyance Portion

Figure 5:
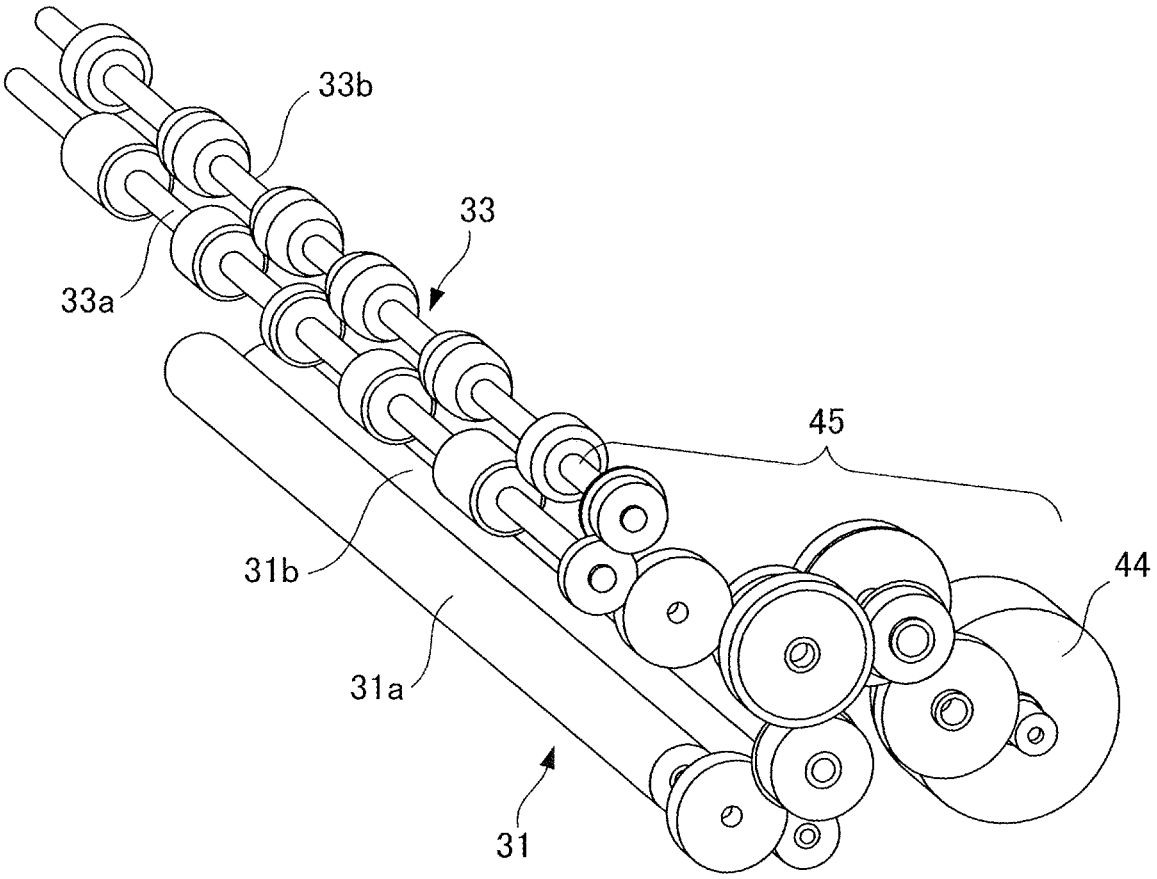
FIG. 5 is a perspective view illustrating a configuration for driving the reversing roller pair and the discharging roller pair of the first embodiment.

FIG. 5 illustrates a configuration for driving the reversing roller pair 31 and the discharging roller pair 33. In the present embodiment, the reversing roller pair 31 and the discharging roller pair 33 shares a single motor 44 that is a driving source, and the driving force of the motor 44 is distributed to the reversing roller pair 31 and the discharging roller pair 33 by a drivetrain 45. That is, the rotation of an output gear of the motor 44 is transmitted to the driving roller 31*b* of the reversing roller pair 31 via a plurality of gears of the drivetrain 45. In parallel with this transmission, the rotation of the output gear of the motor 44 is transmitted also to the discharging lower roller 33*a* and the discharging upper roller 33*b* of the discharging roller pair 33 via the plurality of gears of the drivetrain 45. When the reverse conveyance operation is performed, the motor 44 first rotates in a forward direction (first direction), and thereby the reversing roller pair 31 and the discharging roller pair 33 rotate in such a rotational direction that the reversing roller pair 31 and the discharging roller pair 33 convey the sheet toward the sheet discharging direction. Then the motor 44 rotates in a reverse direction (second direction opposite to the first direction), and thereby the reversing roller pair 31 and the discharging roller pair 33 rotate in such a rotational direction that the reversing roller pair 31 and the discharging roller pair 33 convey the sheet toward the reverse direction. Thus, since the driving source is shared, the power consumption can be reduced and the apparatus can be downsized.

In the configuration in which both the reversing roller pair 31 and the discharging roller pair 33 convey the sheet during the reverse conveyance operation, it is preferable that there is not so large difference in sheet conveyance speed between the reversing roller pair 31 and the discharging roller pair 33. The sheet conveyance speed is a circumferential speed of each of rollers (especially rollers that are applied with driving force) of the reversing roller pair 31 and the discharging roller pair 33.

However, in the configuration in which the driving force of the single motor 44 is distributed to the reversing roller pair 31 and the discharging roller pair 33 via the drivetrain 45, it is difficult to control the conveyance speed of the reversing roller pair 31 and the discharging roller pair 33 independently. In addition, if the circumferential length of a roller of the reversing roller pair 31 and the circumferential length of a roller of the discharging roller pair 33 vary due to the tolerance of outer diameters of the rollers, the difference in conveyance speed between the reversing roller pair 31 and the discharging roller pair 33 may occur.

If the reverse conveyance operation is performed with the difference in conveyance speed between the reversing roller pair 31 and the discharging roller pair 33, the sheet may bend in a portion of the sheet between the reversing roller pair 31 and the discharging roller pair 33, during the conveyance of the sheet in the sheet discharging direction or the reverse direction. In this case, the sheet may strongly rub against the conveyance guide (especially the outer guide 41*b* illustrated in FIG. 2) and be damaged, or may jam the conveyance path. Otherwise, the sheet may be stretched by the reversing roller pair 31 and the discharging roller pair 33 during the conveyance of the sheet in the sheet discharging direction or the reverse direction. In this case, the sheet applied with tension may rub against the conveyance guide (especially the inner guide 41*a* illustrated in FIG. 2) and an image on the sheet may be damaged, or otherwise the reversing roller pair 31 may slip on the sheet, causing the delay of the sheet.

The present embodiment, however, can reduce the influence caused by the difference in conveyance speed, by using the roller pair, as the reversing roller pair 31, in which the outer circumferential surfaces abut against each other, and using the comb-teeth roller pair, as the discharging roller pair 33, in which the outer circumferential surfaces are separated from each other. Hereinafter, behavior of the duplex conveyance portion in the reverse conveyance operation will be described in detail.

Detailed Description of Conveyance Operation

Figure 6B:
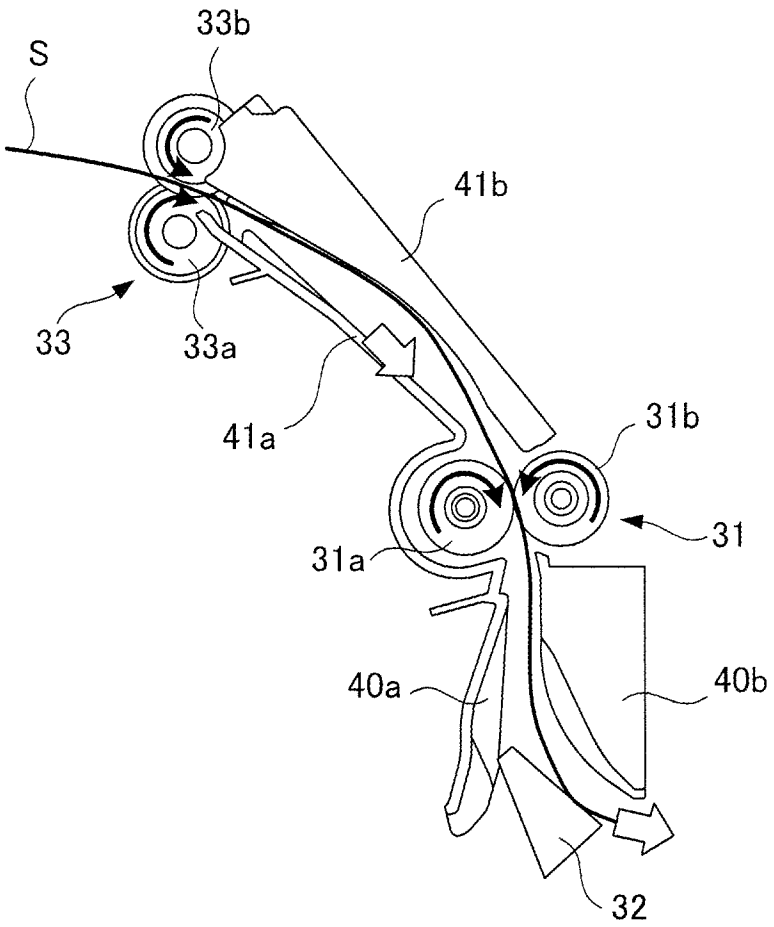
FIG. 6B is a diagram for illustrating a reverse conveyance operation of the first embodiment.
Figure 6A:
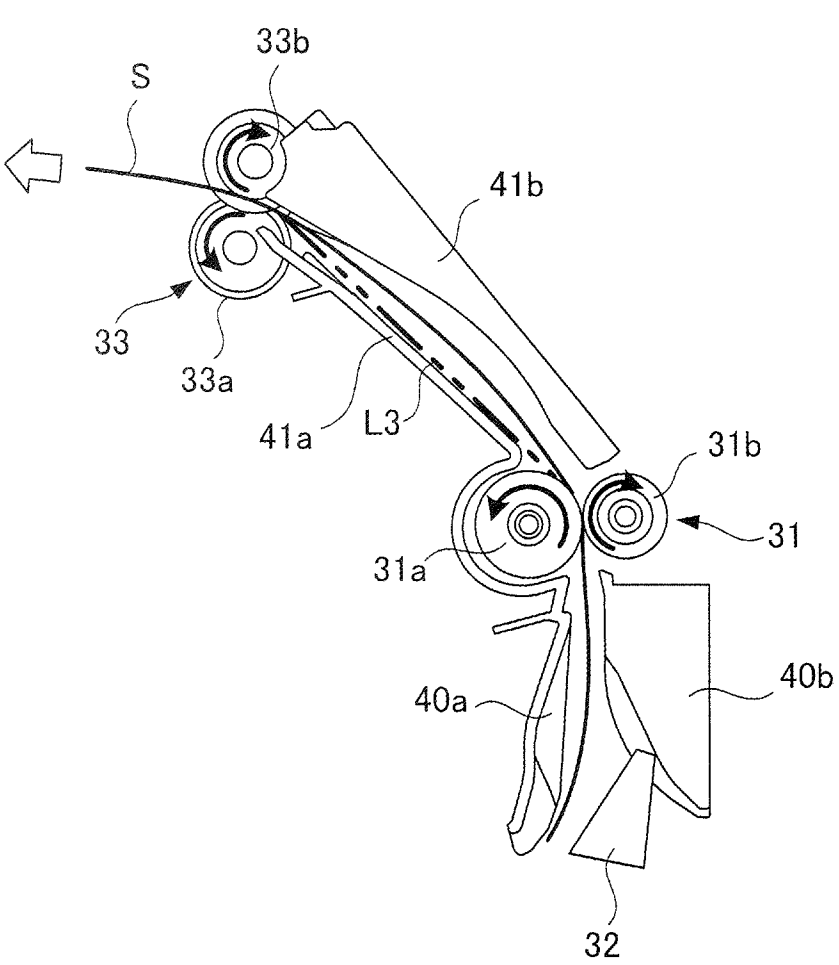
FIG. 6A is a diagram for illustrating a discharging operation of the first embodiment.

FIG. 6A illustrates a state in which the discharging operation is being performed (and a state in the reverse conveyance operation before the conveyance direction of the sheet S is reversed). In the present embodiment, the outer diameter of each roller and the reduction gear ratio of the drivetrain 45 are set so that the circumferential speed of the discharging roller pair 33 becomes higher than the circumferential speed of the reversing roller pair 31. Specifically, the conveyance speed of the discharging roller pair 33 is higher than the conveyance speed of the reversing roller pair 31 by a value equal to or larger than 0.5% and equal to or smaller than 2.0% of the conveyance speed of the reversing roller pair 31. Thus, while the sheet S is nipped by both the reversing roller pair 31 and the discharging roller pair 33 and conveyed toward the sheet discharging direction, the bend of the sheet S formed between the reversing roller pair 31 and the discharging roller pair 33 gradually decreases.

As illustrated in FIG. 6A, when the sheet S is stretched between the reversing roller pair 31 and the discharging roller pair 33 without being bent, the tension of the sheet S is applied to the reversing roller pair 31 and the discharging roller pair 33. In this case, since the conveyance force of the discharging roller pair 33 is smaller than the conveyance force of the reversing roller pair 31, the discharging roller pair 33 slips on the sheet S. On the other hand, the sheet S is sent from the nip portion of the reversing roller pair 31 at the conveyance speed of the reversing roller pair 31.

Since the discharging roller pair 33 slips on the sheet S, any tension larger than the conveyance force of the discharging roller pair 33 can be prevented from being applied to the sheet S. As a result, the possibility that the image surface of the sheet S strongly rubs against the inner guide 41*a* and the image is disadvantageously damaged can be reduced.

The inner guide 41*a* located between the reversing roller pair 31 and the discharging roller pair 33 is disposed so as not to contact a line L3 that contacts the driven roller 31*a* of the reversing roller pair 31 and the discharging lower roller 33*a* of the discharging roller pair 33. Since the driven roller 31*a* and the discharging lower roller 33*a* are positioned on the same side as the guide 41*a* with respect to a position at which the sheet passes through, the line L3 corresponds to a position of the sheet stretched between the reversing roller pair 31 and the discharging roller pair 33 without being bent. Thus, since the guide 41*a* is retracted from the line L3, the possibility that the image surface of the sheet S rubs against the guide 41*a* can be more reliably reduced.

In addition, when the discharging operation is performed, the wave of the sheet S produced by the comb-teeth discharging roller pair 33 can increase stiffness of the sheet S that is being discharged. With the increased stiffness, the sheet S that is being discharged can be suppressed from bending down and contacting other sheets stacked on the discharging tray 25. Consequently, the sheet S can be more neatly stacked on the discharging tray 25.

FIG. 6B illustrates a state in the reverse conveyance operation, produced after conveyance of the sheet S in the reverse direction is started. When the conveyance of the sheet S in the reverse direction is performed, the conveyance speed of the discharging roller pair 33 is also higher than the conveyance speed of the reversing roller pair 31 by a value equal to or larger than 0.5% and equal to or smaller than 2.0% of the conveyance speed of the reversing roller pair 31. Thus, while the sheet S is nipped by both the reversing roller pair 31 and the discharging roller pair 33 and conveyed toward the reverse direction, the bend of the sheet S formed between the reversing roller pair 31 and the discharging roller pair 33 gradually increases.

As illustrated in FIG. 6B, when the bend of the sheet S formed between the reversing roller pair 31 and the discharging roller pair 33 increases, the outer surface (i.e. the surface opposite to the image surface) of the bent sheet S abuts against the outer guide 41*b*. Even if the discharging roller pair 33 tries to further push the sheet S in this state, the sheet S is pushed back by the guide 41*b* and the bend of the sheet S does not increase any more. In this time, since the conveyance force of the discharging roller pair 33 is smaller than the conveyance force of the reversing roller pair 31, the discharging roller pair 33 slips on the sheet S. On the other hand, the sheet S is sent from the nip portion of the reversing roller pair 31 at the conveyance speed of the reversing roller pair 31.

Since the discharging roller pair 33 slips on the sheet 5, any pushing force larger than the conveyance force of the discharging roller pair 33 can be prevented from being applied and from pushing the sheet S against the guide 41*b*. As a result, the possibility that the sheet S strongly rubs against the outer guide 41*b* and the sheet is damaged can be reduced.

As described above, the discharging roller pair 33 is a comb-teeth roller pair; and the reversing roller pair 31, which is located closer to the reconveyance path P4 than the discharging roller pair 33, nips the sheet S in the nip portion, which extends straight in the width direction when viewed from the sheet discharging direction. Thus, in the reverse conveyance operation, the wave of the sheet S produced by the discharging roller pair 33 can be prevented from propagating a downstream part of the sheet S in the reverse direction across the reversing roller pair 31. As a result, the increase of conveyance resistance that would be caused by the wave of the sheet S when the sheet S passes through a curved portion 47 (see FIG. 1) of the reconveyance path P4 can be prevented, so that the stability of sheet conveyance in the reconveyance path P4 is improved. In particular, in the present embodiment, since the nip portion of the reversing roller pair 31 extends in the width direction, over the area containing the entire image forming area, the wave of the sheet S can be more reliably prevented from propagating downstream in the reverse direction.

Summary of Conveyance Operation

Thus, the present embodiment causes the discharging roller pair 33 to more easily slip on the sheet than the reversing roller pair 31, by using the roller pair, as the reversing roller pair 31, in which the outer circumferential surfaces abut against each other, and using the comb-teeth roller pair, as the discharging roller pair 33, in which the outer circumferential surfaces are separated from each other. In other words, the upstream roller pair includes the first roller and the second roller whose outer circumferential surfaces abut against each other, and the downstream roller pair located downstream of the upstream roller pair in the sheet discharging direction includes the third roller and the fourth roller, which are formed like comb teeth. Thus, even if there is a difference in conveyance speed between the upstream roller pair and the downstream roller pair, the possibility that the stability of sheet conveyance is affected by the difference in conveyance speed can be reduced. The difference in conveyance speed between the upstream roller pair and the downstream roller pair can be produced unintentionally, for example, by the tolerance of outer diameters of rollers, and intentionally as in the present embodiment.

In addition, in the present embodiment, the sheet conveyance path is curved in a portion of the sheet conveyance path between the reversing roller pair 31 and the discharging roller pair 33. In such a configuration, even if the sheet is bent or stretched due to the difference in conveyance speed, the present embodiment can prevent the sheet from strongly rubbing against the inner guide 41*a* or the outer guide 41*b* and reduce the possibility that the sheet or an image on the sheet is damaged.

In addition, in the present embodiment, the reversing roller pair 31 and the discharging roller pair 33 are driven by the single motor. Thus, although it is difficult to control the conveyance speed of the two roller pairs independently, the possibility that the stability of sheet conveyance is affected by the difference in conveyance speed can be reduced. Note that, however, the present technique can also be applied to a configuration in which two driving sources are provided for driving the reversing roller pair 31 and the discharging roller pair 33.

In the present embodiment, since the discharging roller pair 33 is a comb-teeth roller pair, the conveyance force of the discharging roller pair 33 is smaller than the conveyance force of the reversing roller pair 31. Instead of this, the discharging roller pair 33 may also be a roller pair in which the outer circumferential surfaces of the rollers abut against each other, and the abutment pressure of the discharging roller pair 33 may be smaller than the abutment pressure of the reversing roller pair 31 for producing the difference in conveyance force. In another case, the discharging roller pair 33 may be a roller pair in which the outer circumferential surfaces of the rollers abut against each other, and the discharging roller pair 33 may have a structure that causes the discharging roller pair 33 to more easily slip on the sheet than the reversing roller pair 31. In short, the discharging roller pair 33 may have any structure as long as the structure causes the conveyance force of the discharging roller pair 33 to be smaller than the conveyance force of the reversing roller pair 31 for at least some (preferably all) of types of sheets on which the image forming apparatus can perform duplex printing.

In addition, in the present embodiment, the conveyance speed of the discharging roller pair 33 is slightly higher than the conveyance speed of the reversing roller pair 31. However, the conveyance speed may be changed. For example, the target value of the conveyance speed of the discharging roller pair 33 may be equal to or slightly higher than the conveyance speed of the reversing roller pair 31.

Second Embodiment

Next, a duplex conveyance portion of a printer of a second embodiment will be described. The present embodiment differs from the first embodiment in details of the shape of the guide 41*b*, which is disposed between the reversing roller pair 31 and the discharging roller pair 33 for guiding the sheet. The other configuration, such as the configuration of the reversing roller pair 31 and the discharging roller pair 33 and the configuration for driving the reversing roller pair 31 and the discharging roller pair 33, is the same as that of the first embodiment. Thus, the present embodiment can also reduce the possibility that the stability of sheet conveyance is affected by the difference in conveyance speed between the reversing roller pair 31 and the discharging roller pair 33. Hereinafter, since a component given a symbol identical to a symbol of the first embodiment has the same structure and effect as those of the first embodiment, the description thereof will be omitted.

Figure 7A:
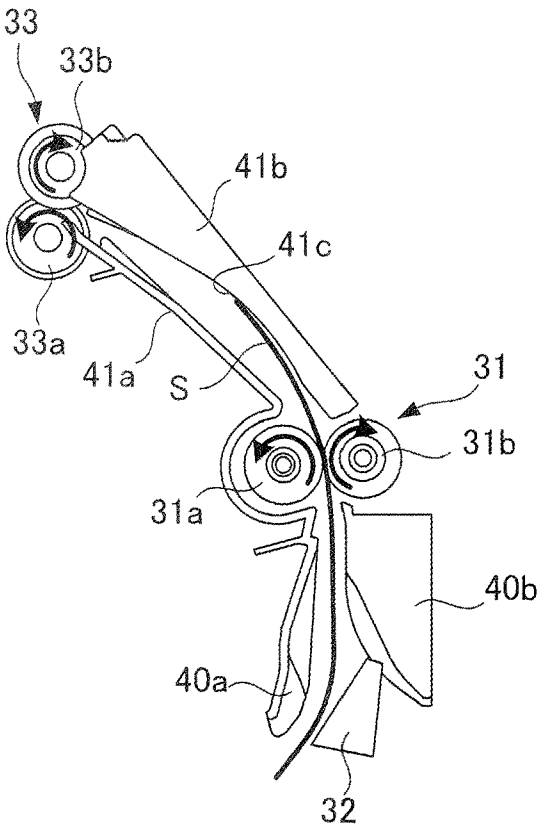
FIG. 7A is a diagram for illustrating a reverse conveyance operation of a second embodiment.
Figure 7B:
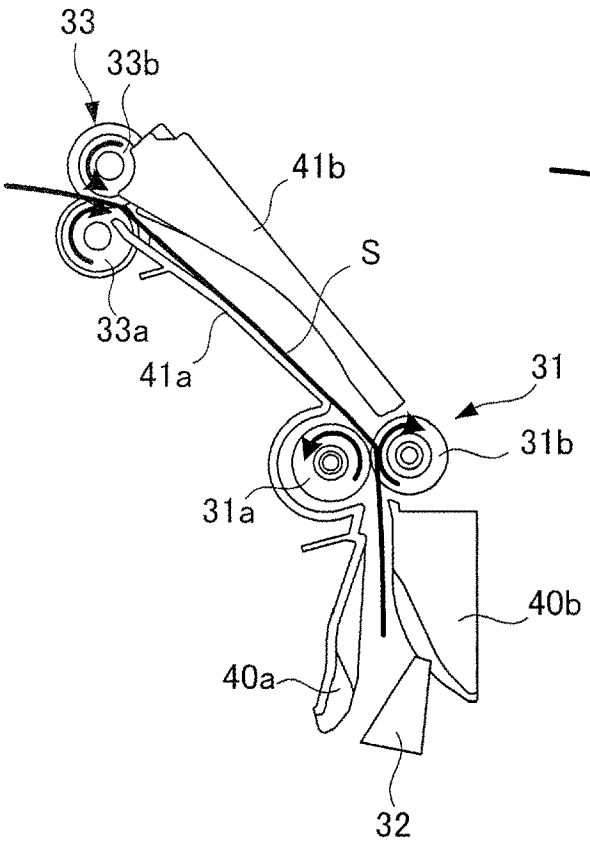
FIG. 7B is a diagram for illustrating the reverse conveyance operation of the second embodiment.
Figure 7C:
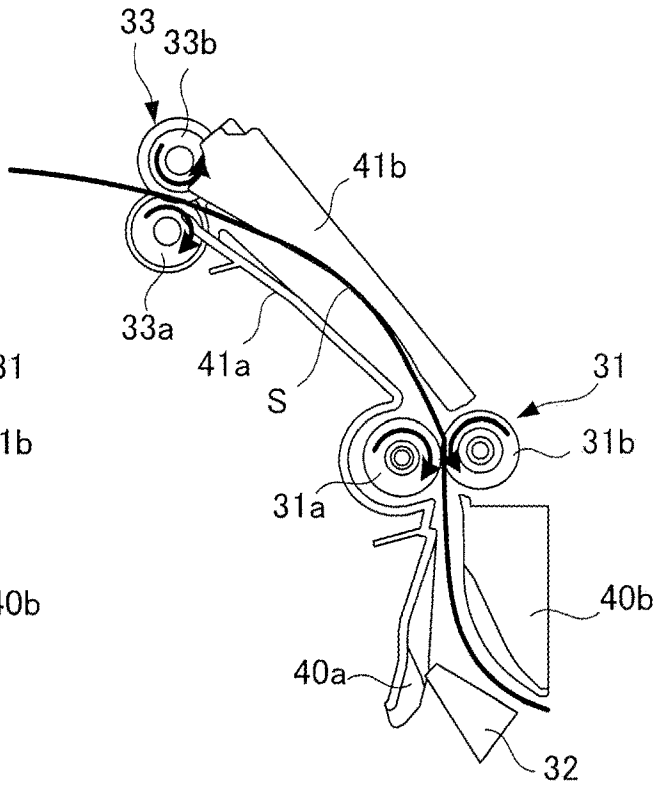
FIG. 7C is a diagram for illustrating the reverse conveyance operation of the second embodiment.

FIGS. 7A to 7C illustrate a reverse conveyance operation of the present embodiment. As illustrated in FIG. 7A, the leading edge of the sheet S sent from the reversing roller pair 31 toward the sheet discharging direction is guided to the guide surface 41*c* of the outer guide 41*b*, and then to the discharging roller pair 33. As illustrated in FIG. 7B, when the sheet S is nipped by the discharging roller pair 33, the sheet S is conveyed toward the sheet discharging direction while stretched between the reversing roller pair 31 and the discharging roller pair 33. When the trailing edge of the sheet S passes the delivery guide member 32, the delivery guide member 32 is switched to another position, and the reversing roller pair 31 and the discharging roller pair 33 rotate in a reverse direction. With this operation, the sheet S is conveyed toward the reverse direction and sent to the reconveyance path, as illustrated in FIG. 7C.

Also in the present embodiment, the conveyance speed of the discharging roller pair 33 is slightly higher than the conveyance speed of the reversing roller pair 31. Thus, as illustrated in FIG. 7C, when the sheet S is conveyed toward the reverse direction by the reversing roller pair 31 and the discharging roller pair 33, the bend of the sheet S formed between the reversing roller pair 31 and the discharging roller pair 33 gradually increases, and the sheet S abuts against the outer guide 41*b*. The abutment position at which the sheet S abuts against the guide 41*b* in the sheet conveyance direction is located almost halfway between the discharging roller pair 33 and the reversing roller pair 31.

Figure 8:
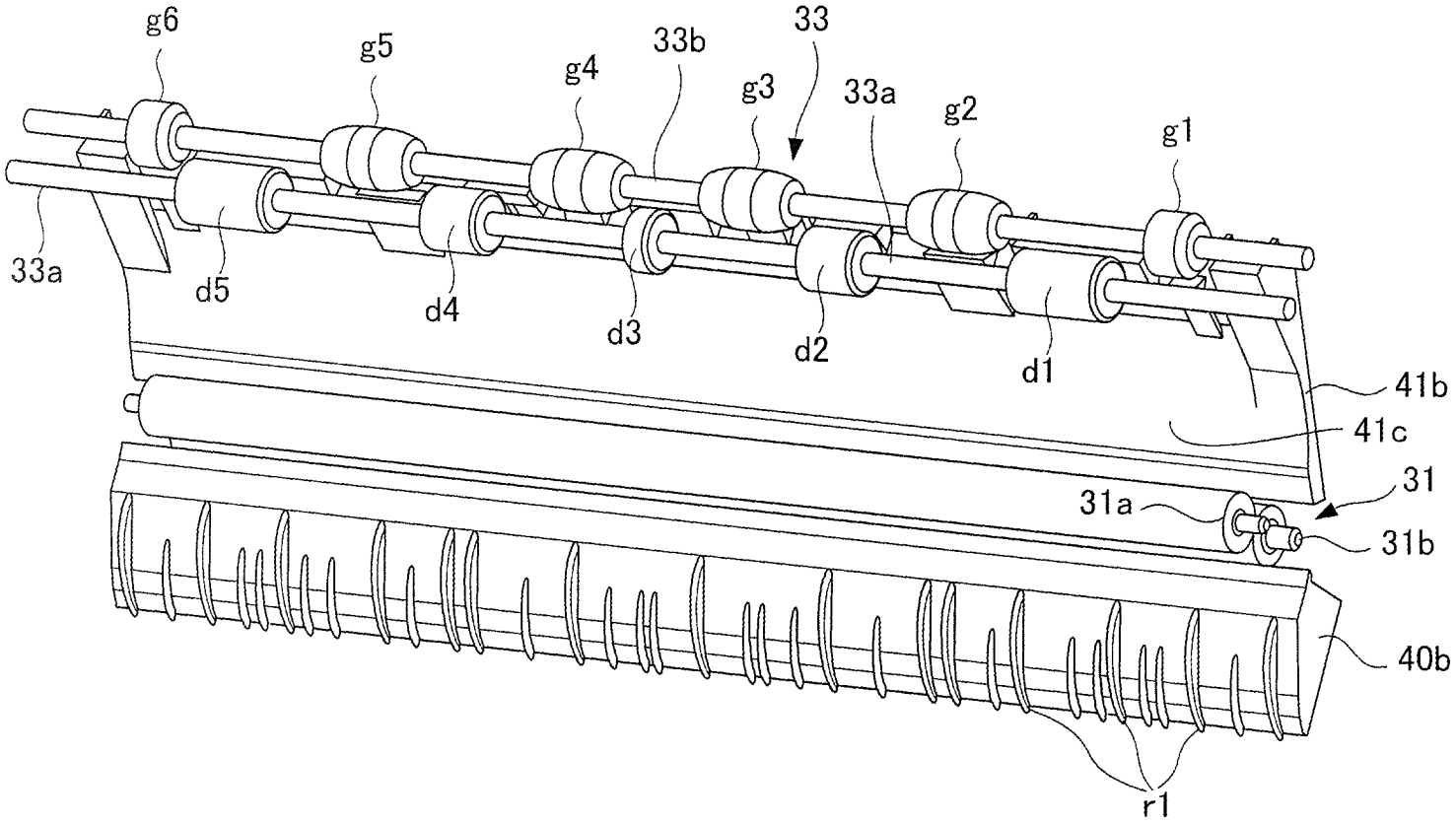
FIG. 8 is a diagram for illustrating a shape of a guide of the second embodiment.

FIG. 8 is a perspective view illustrating a shape of the guide surface 41*c* of the outer guide 41*b*. In FIG. 8, the inner guide 41*a* is omitted. The guide surface 41*c* of the present embodiment is a smooth surface that extends along the sheet conveyance direction when viewed from the width direction, and extends in the width direction. Preferably, the guide surface 41*c* extends in the width direction, over an area containing the entire image forming area. In addition, no members (see ribs r1 of the guide 40*b*, for example) project from the guide surface 41*c* in the image forming area.

Thus, in the present embodiment, the guide 41*b* guides the sheet, which is bent in a portion of the sheet between the reversing roller pair 31 and the discharging roller pair 33, at a position outside the sheet; and the whole surface of the guide 41*b* that faces the sheet is the smooth guide surface 41*c*. As a result, the configuration of the present embodiment can reduce the damage to the sheet and the occurrence of image defects, compared to a configuration in which ribs are formed in the whole of the guide surface 41*c*, because the abutment pressure between the bent sheet and the guide 41*b* is dispersed.

Note that the whole surface of the guide 41*b* that faces the sheet may not be the smooth guide surface 41*c*. As described in the following first and second modifications as examples, the guide 41*b* may have a predetermined area that occupies at least a portion of the guide 41*b* between the reversing roller pair 31 and the discharging roller pair 33 in the sheet discharging direction and having no members that project from the guide surface 41*c* in the image forming area, which extends in the width direction.

First Modification

Figure 9:
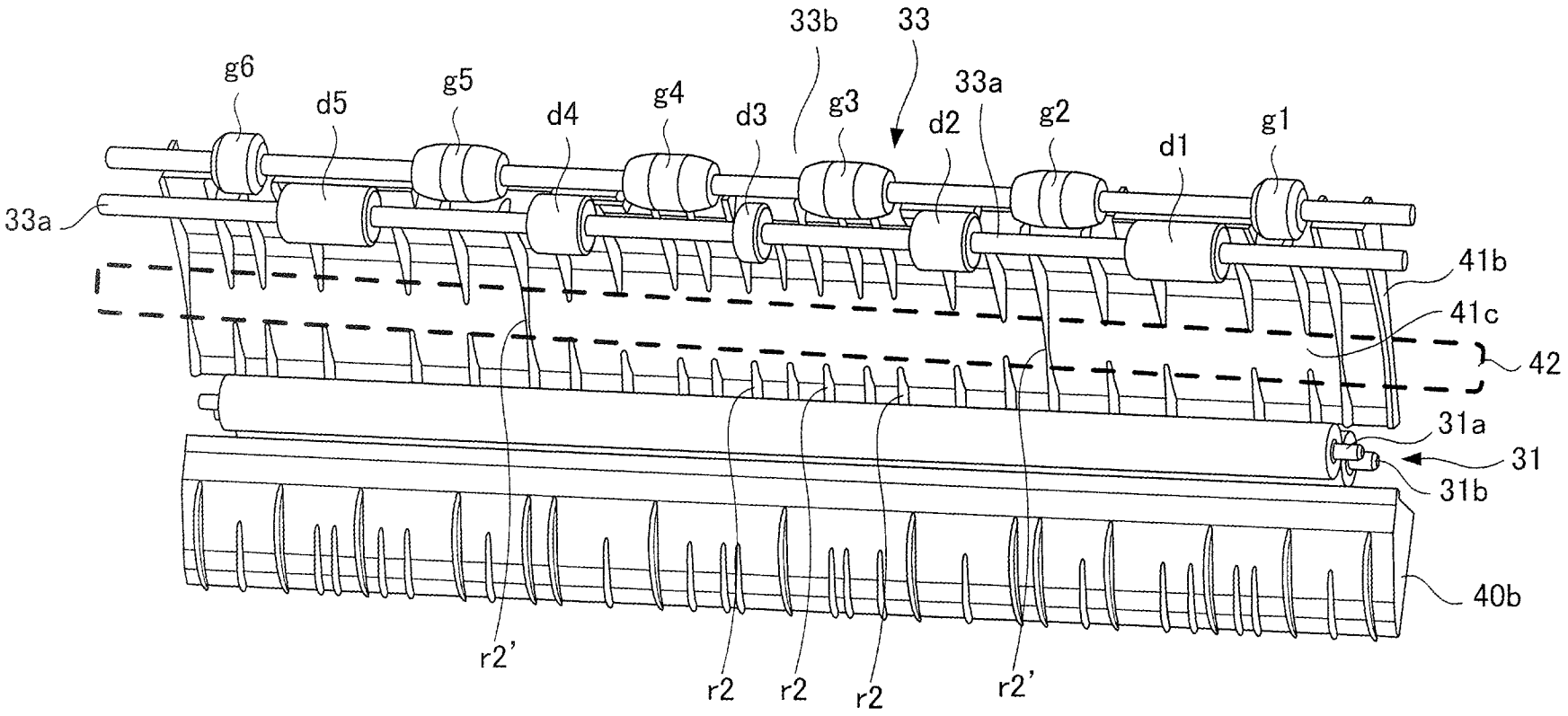
FIG. 9 is a diagram for illustrating a shape of a guide of a first modification.

FIG. 9 illustrates another shape of the guide 41*b*. In this modification, a predetermined area 42 constituted by the smooth guide surface 41*c* is provided in a portion, in the sheet discharging direction, of the surface of the guide 41*b* that faces the sheet. In an area of the guide 41*b* that is adjacent to the area 42 in the sheet discharging direction, a plurality of ribs r2 projects from the guide surface 41*c* and extends in the sheet discharging direction. Even in such a structure, since the abutment pressure between the bent sheet and the guide 41*b* is dispersed at least in the area 42, the damage to the sheet and the occurrence of image defects can be reduced. The predetermined area 42 may have no ribs, or may have fewer ribs r2' than those of the adjacent area.

Second Modification

Figure 10:
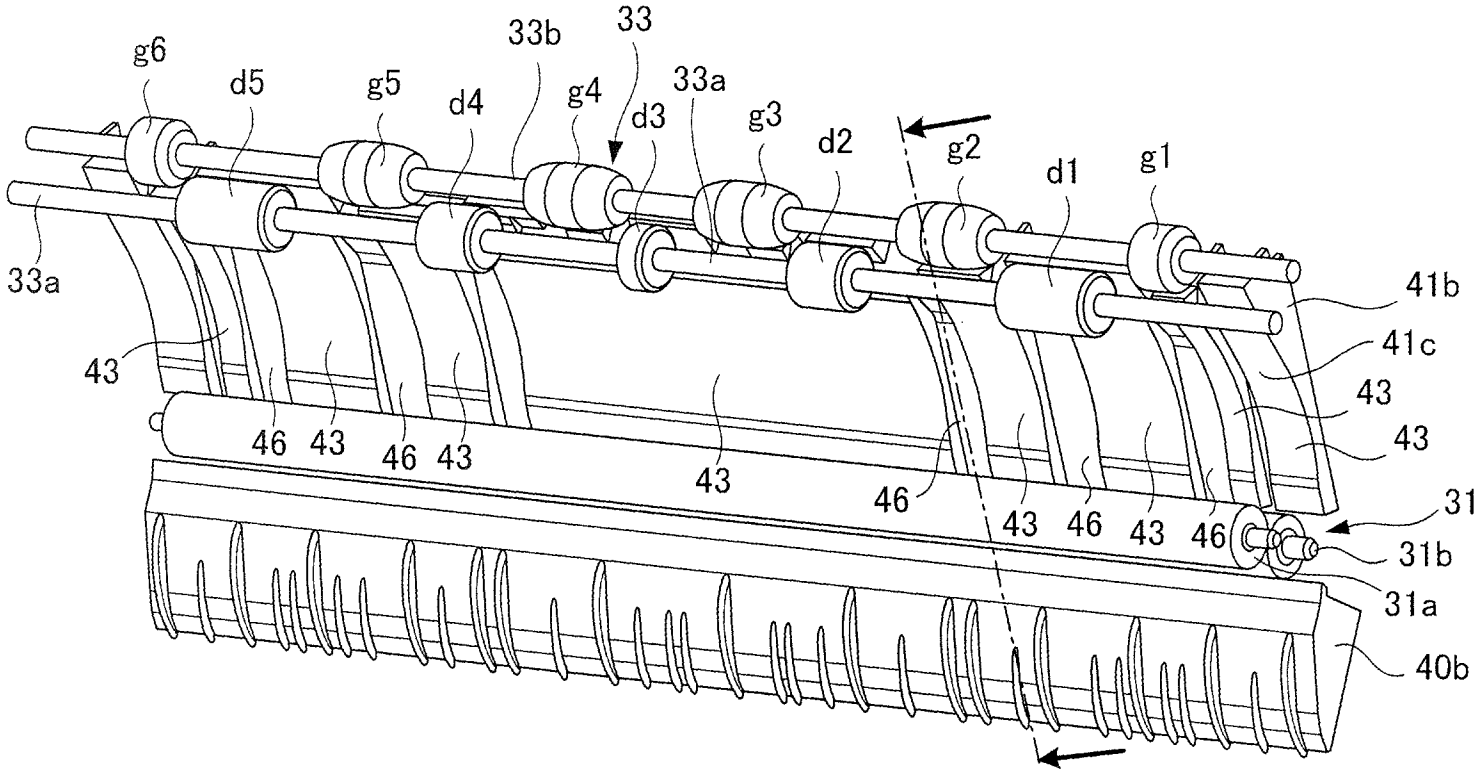
FIG. 10 is a diagram for illustrating a shape of a guide of a second modification.

FIG. 10 illustrates another shape of the guide 41*b*. In this modification, recesses 46 are formed in a portion of the smooth guide surface 41*c*. The recesses 46 are concave portions that are concaved toward a direction extending away from an area that the sheet passes through. The guide surface 41*c* is divided into a plurality of areas 43 by the plurality of recesses 46 in the width direction. In this modification, the predetermined area in which no projecting portions are formed is constituted by the guide surface 41*c* and the recesses 46.

Figure 11:
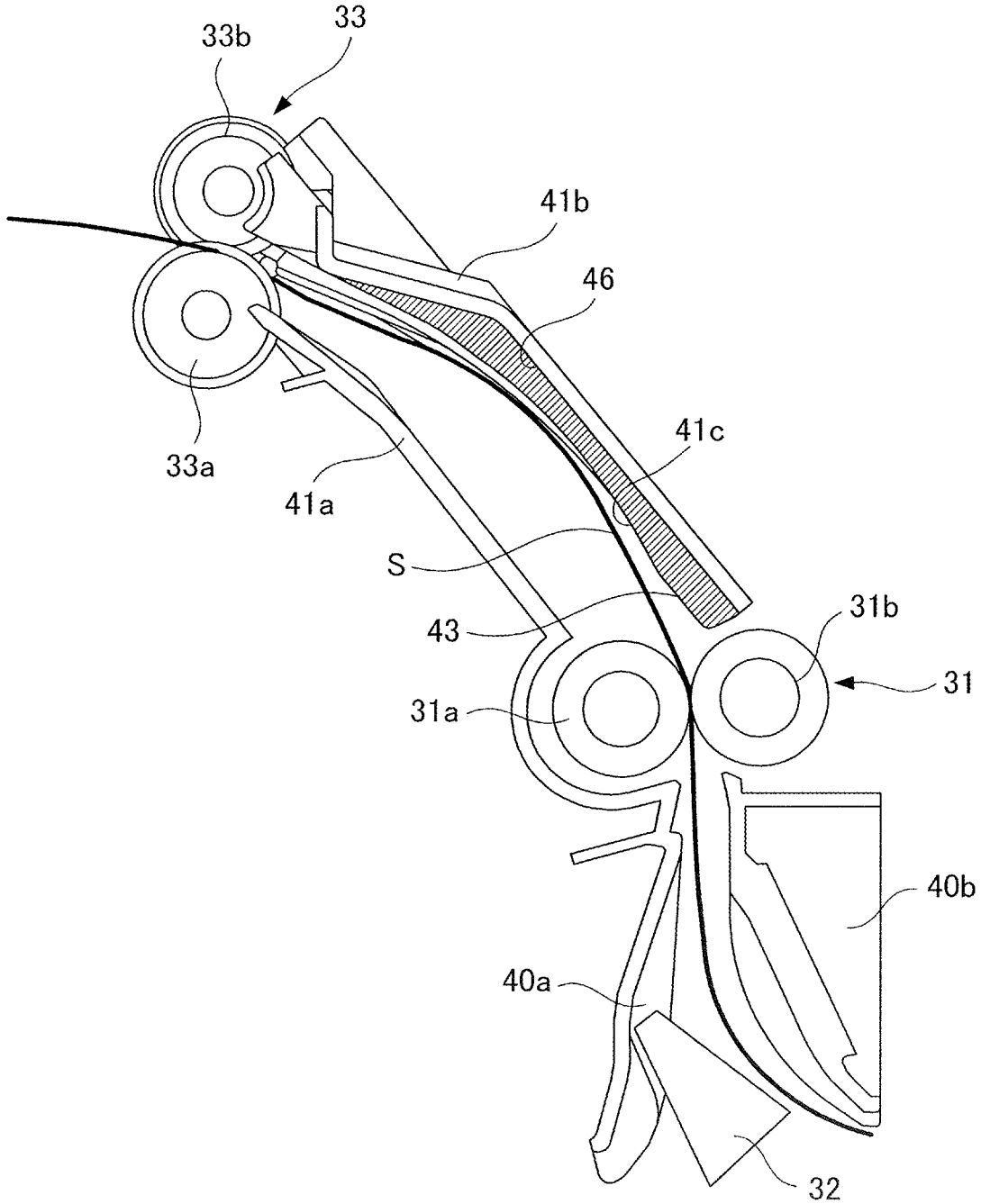
FIG. 11 is a cross-sectional view for illustrating the shape of the guide of the second modification.

FIG. 11 illustrates a cross section taken at a cut position of FIG. 10. The recesses (hatched portion) 46 are formed along the sheet conveyance direction. Since the recesses 46 do not project from the guide surface 41*c*, and have a smaller area than the guide surface 41*c*, the effect of dispersing the abutment pressure applied between the sheet and the guide 41*b* is kept. In addition, even when the sheet is bent more and closer to the guide surface 41*c*, the recesses 46 suppress the temperature rise of the guide 41*b*. As a result, the possibility that the guide 41*b* is deformed by heat can be reduced, and the high stability in sheet conveyance can be kept for a long time.

Other Modifications

Although the intermediate-transfer electrophotographic unit (image forming process portion 10) is used as an image forming portion in the first and the second embodiments, another image forming portion may be used. For example, a direct-transfer electrophotographic unit, which directly transfers a toner image formed on a photosensitive member to a recording medium, may be used. Otherwise, another image forming unit having another system, such as the ink-jet system or the offset-printing system, other than the electrophotographic system may be used.

Other Embodiments

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-036269, filed on Feb. 28, 2019, which is hereby incorporated by reference herein in its entirety.

What is claimed is:

1. An image forming apparatus comprising:

an image forming portion configured to form an image on a sheet;

a first conveyance path through which a sheet passes in a case where a sheet on which an image has been formed by the image forming portion is discharged to an outside of the image forming apparatus;

a second conveyance path which branches from the first conveyance path and through which a sheet passes in a case where a sheet on which an image has been formed by the image forming portion is conveyed toward the image forming portion again;

an upstream roller pair disposed on the first conveyance path and positioned downstream of, in a sheet discharging direction in the first conveyance path, a position at which the second conveyance path branches from the first conveyance path, the upstream roller pair comprising a first roller and a second roller abutting with each other and being configured to nip and convey a sheet by the first roller and the second roller; and a downstream roller pair disposed on the first conveyance path and positioned downstream of the upstream roller pair in the sheet discharging direction, the downstream roller pair comprising a third roller including a plurality of first rotary members aligned in a width direction orthogonal to the sheet discharging direction and a fourth roller including a plurality of second rotary members arranged on positions in the width direction alternately with positions of the plurality of first rotary members in the width direction, the plurality of first rotary members being configured to overlap at least partially with the plurality of second rotary members when viewed from the width direction, wherein the second roller is a driving roller configured to be rotated by driving force from a driving source, wherein an outer circumferential portion of the second roller is made of elastic material, wherein outer circumferential portions of the plurality of first rotary members and outer circumferential portions of the plurality of second rotary members are made of material softer than the elastic material, wherein the downstream roller pair is configured to nip and convey a sheet by the third roller and the fourth roller in a state that areas in the width direction where the plurality of first rotary members contact a first surface of a sheet do not overlap with areas in the width direction where the plurality of second rotary members contact a second surface of a sheet opposite to the first surface, and wherein the image forming apparatus is configured to perform a reverse conveyance operation in which a sheet on which an image has been formed by the image forming portion is conveyed in the sheet discharging direction by both the upstream roller pair and the downstream roller pair and is then conveyed in a reverse direction opposite to the sheet discharging direction to the second conveyance path by both the upstream roller pair and the downstream roller pair.

2. The image forming apparatus according to claim 1, wherein a nip portion at which an outer circumferential surface of the first roller and an outer circumferential surface of the second roller abut with each other extends continuously over an area in the width direction containing an entire image forming area in which the image forming portion can form an image on a sheet.

3. The image forming apparatus according to claim 1, wherein the outer circumferential portion of the second roller is made of silicone rubber, and wherein the outer circumferential portions of the plurality of first rotary members and the outer circumferential portions of the plurality of second rotary members are made of urethane foam resin.

4. The image forming apparatus according to claim 1, wherein a static friction coefficient of the second roller to plain paper is larger than static friction coefficients of the plurality of first rotary members and the plurality of second rotary members to the plain paper.

5. The image forming apparatus according to claim 1, wherein the upstream roller pair and the downstream roller pair are configured such that an upper limit of a conveyance force that is applied to a sheet by the downstream roller pair without slipping of the downstream roller pair on a sheet is smaller than an upper limit of a conveyance force that is applied to a sheet by the upstream roller pair without slipping of the upstream roller pair on a sheet.

6. The image forming apparatus according to claim 1, wherein the upstream roller pair and the downstream roller pair are configured such that a pull-out load to pull out a sheet from the downstream roller pair that is in a stop state is smaller than a pull-out load to pull out a sheet from the upstream roller pair that is in a stop state.

7. The image forming apparatus according to claim 1, wherein the first conveyance path is provided with an inner guide and an outer guide both located between the upstream roller pair and the downstream roller pair in the sheet discharging direction and configured to guide a sheet, wherein a sheet, on which an image has been formed on the first surface by the image forming portion and which is subjected to the reverse conveyance operation, is bent when passing through a portion of the first conveyance path between the upstream roller pair and the downstream roller pair, such that the first surface becomes an inner surface of the bent sheet and the second surface becomes an outer surface of the bent sheet, and wherein the inner guide and the outer guide are disposed to face the first surface and the second surface, respectively, of the bent sheet that is subjected to the reverse conveyance operation.

8. The image forming apparatus according to claim 7, further comprising a motor configured to drive the upstream roller pair and the downstream roller pair, wherein the upstream roller pair and the downstream roller pair are configured such that a circumferential speed of the downstream roller pair is higher than a circumferential speed of the upstream roller pair.

9. The image forming apparatus according to claim 8, wherein the upstream roller pair and the downstream roller pair are configured such that the circumferential speed of the downstream roller pair is higher than the circumferential speed of the upstream roller pair by a value equal to or larger than 0.5% and equal to or smaller than 2.0% of the circumferential speed of the upstream roller pair.

10. The image forming apparatus according to claim 7, wherein the outer guide comprises a guide surface extending along the sheet discharging direction when viewed from the width direction and extending in the width direction, wherein the outer guide is provided with a predetermined area which occupies at least a portion of the outer guide between the upstream roller pair and the downstream roller pair in the sheet discharging direction and in which no projecting member that projects from the guide surface is provided over an entire image forming area in the width direction in which the image forming portion can form an image on a sheet.

11. The image forming apparatus according to claim 10, wherein the outer guide comprises a concave portion provided within the image forming area in the width direction and concaved with respect to the guide surface, and wherein the predetermined area is constituted by the guide surface and the concave portion.

12. The image forming apparatus according to claim 10, wherein the outer guide comprises a plurality of ribs projecting from the guide surface and extending in the sheet discharging direction, wherein the plurality of ribs is provided on a portion of the outer guide between the upstream roller pair and the downstream roller pair in the sheet discharging direction, and wherein the predetermined area is an area where any one of the plurality of ribs is not provided.

13. The image forming apparatus according to claim 7, wherein the outer guide comprises a guide surface and a plurality of ribs, wherein the guide surface extends along the sheet discharging direction when viewed from the width direction and extends in the width direction, over an area in the width direction containing an entire image forming area in which the image forming portion can form an image on a sheet, wherein the plurality of ribs projects from the guide surface and extends in the sheet discharging direction, and wherein a number of ribs, among the plurality of ribs, that are located on a portion of the guide surface in the sheet discharging direction is fewer than a number of ribs, among the plurality of ribs, that are located on another portion of the guide surface in the sheet discharging direction.

14. The image forming apparatus according to claim 1, wherein the image forming apparatus is configured such that in the reverse conveyance operation, the upstream roller pair and the downstream roller pair start to convey a sheet in the reverse direction after a trailing edge, in the sheet discharging direction, of a sheet in being conveyed in the sheet discharging direction has passed the position at which the second conveyance path branches from the first conveyance path and before the trailing edge passes through the upstream roller pair.

15. An image forming apparatus comprising:

an image forming portion configured to form an image on a sheet;

a first conveyance path through which a sheet passes in a case where a sheet on which an image has been formed by the image forming portion is discharged to an outside of the image forming apparatus;

a second conveyance path which branches from the first conveyance path and through which a sheet passes in a case where a sheet on which an image has been formed by the image forming portion is conveyed toward the image forming portion again;

an upstream roller pair disposed on the first conveyance path and positioned downstream of, in a sheet discharging direction in the first conveyance path, a position at which the second conveyance path branches from the first conveyance path, the upstream roller pair comprising a first roller and a second roller abutting with each other and being configured to nip and convey a sheet by the first roller and the second roller; and a downstream roller pair disposed on the first conveyance path and positioned downstream of the upstream roller pair in the sheet discharging direction, the downstream roller pair comprising a third roller including a plurality of first rotary members aligned in a width direction orthogonal to the sheet discharging direction and a fourth roller including a plurality of second rotary members arranged on positions in the width direction alternately with positions of the plurality of first rotary members in the width direction, the plurality of first rotary members being configured to overlap at least partially with the plurality of second rotary members when viewed from the width direction, wherein the downstream roller pair is configured to nip and convey a sheet by the third roller and the fourth roller in a state that areas in the width direction where the plurality of first rotary members contact a first surface of a sheet do not overlap with areas in the width direction where the plurality of second rotary members contact a second surface of a sheet opposite to the first surface, wherein the image forming apparatus is configured to perform a reverse conveyance operation in which a sheet on which an image has been formed by the image forming portion is conveyed in the sheet discharging direction by both the upstream roller pair and the downstream roller pair and is then conveyed in a reverse direction opposite to the sheet discharging direction to the second conveyance path by both the upstream roller pair and the downstream roller pair, wherein the second roller is a driving roller configured to be rotated by driving force from a driving source, wherein a static friction coefficient of the second roller to plain paper is larger than static friction coefficients of the plurality of first rotary members and the plurality of second rotary members to the plain paper, and wherein the upstream roller pair and the downstream roller pair are configured such that a pull-out load to pull out a sheet from the downstream roller pair that is in a stop state is smaller than a pull-out load to pull out a sheet from the upstream roller pair that is in a stop state.

16. An image forming apparatus comprising:

an image forming portion configured to form an image on a sheet;

a first conveyance path through which a sheet passes in a case where a sheet on which an image has been formed by the image forming portion is discharged to an outside of the image forming apparatus;

a second conveyance path which branches from the first conveyance path and through which a sheet passes in a case where a sheet on which an image has been formed by the image forming portion is conveyed toward the image forming portion again;

an upstream roller pair disposed on the first conveyance path and positioned downstream of, in a sheet discharging direction in the first conveyance path, a position at which the second conveyance path branches from the first conveyance path, the upstream roller pair comprising a first roller and a second roller abutting with each other and being configured to nip and convey a sheet by the first roller and the second roller, wherein a nip portion at which an outer circumferential surface of the first roller and an outer circumferential surface of the second roller abut with each other extends continuously over an area in the width direction containing an entire image forming area in which the image forming portion can form an image on a sheet; and a downstream roller pair disposed on the first conveyance path and positioned downstream of the upstream roller pair in the sheet discharging direction, the downstream roller pair comprising a third roller including a plurality of first rotary members aligned in a width direction orthogonal to the sheet discharging direction and a fourth roller including a plurality of second rotary members arranged on positions in the width direction alternately with positions of the plurality of first rotary members in the width direction, the plurality of first rotary members being configured to overlap at least partially with the plurality of second rotary members when viewed from the width direction, wherein the downstream roller pair is configured to nip and convey a sheet by the third roller and the fourth roller in a state that areas in the width direction where the plurality of first rotary members contact a first surface of a sheet do not overlap with areas in the width direction where the plurality of second rotary members contact a second surface of a sheet opposite to the first surface, and wherein the image forming apparatus is configured to perform a reverse conveyance operation in which a sheet on which an image has been formed by the image forming portion is conveyed in the sheet discharging direction by both the upstream roller pair and the downstream roller pair and is then conveyed in a reverse direction opposite to the sheet discharging direction to the second conveyance path by both the upstream roller pair and the downstream roller pair.

* * * * *